United States Patent [19]

Zarotti

[11] Patent Number: 4,853,980

[45] Date of Patent: Aug. 8, 1989

[54] PROTECTIVE BUFFER PADDING ELEMENT

[75] Inventor: Claudio Zarotti, Milan, Italy

[73] Assignee: Sonda S.r.l., Milan, Italy

[21] Appl. No.: 902,409

[22] Filed: Aug. 19, 1986

[30] Foreign Application Priority Data

Dec. 21, 1984 [IT] Italy ..... 24164 A/84

[51] Int. Cl.[4] ..... A42B 3/02

[52] U.S. Cl. ..... 2/413; 2/414

[58] Field of Search ..... 2/413, 414, 417, 411; 188/269; 267/113, 64.13, 142-146; 604/141

[56] References Cited

U.S. PATENT DOCUMENTS

| | | | |
|---|---|---|---|
| 3,609,764 | 10/1971 | Morgan | 2/414 |
| 3,866,243 | 2/1975 | Morgan | 2/413 X |
| 4,023,213 | 5/1977 | Rovani | 2/413 |
| 4,265,241 | 5/1981 | Portner et al. | 604/141 X |
| 4,535,977 | 8/1985 | Strong | 188/269 X |
| 4,566,137 | 1/1986 | Grooding | 2/413 |
| 4,589,405 | 5/1986 | Hemmeter | 128/79 |

*Primary Examiner*—Werner H. Schroeder

*Attorney, Agent, or Firm*—Sughrue, Mion, Zinn, Macpeak & Seas

[57] ABSTRACT

A padding element suitable for use in a crash helmet having a plurality of padding elements including a plurality of first deformable blisters interconnected together in sets, and containing a fluid which is in a saturated vapor state when the helmet has been worn for a sufficient time to raise its fluid temperature to a temperature approaching normal body temperature. It is contemplated that the fluid contained in the first deformable blisters preferably includes a mixture of Freon MF and Freon TF with the proportion of Freon MF being in the range of 20% to 50% by volume liquid.

14 Claims, 2 Drawing Sheets

PROTECTIVE BUFFER PADDING ELEMENT

DESCRIPTION

1. Technical Field

This invention relates to a protective buffer padding element, particularly for use with a crash helmet, including a deformable blister.

2. Background Art

In many situations, often connected with the practice of some sport (motoring, motorcycling, skiing, hockey-playing, American football-playing, etc.), but occasionally also of some trades (work at construction yards, mines, etc.) or else, where the use of crash helmet may be a commendable, if not altogether compulsory, measure an improved protective buffer padding element is needed.

Crash helmets usually have different characteristics dependent on their intended applications, but they all include a deformable inner padding which is mainly directed to absorb at least part of the impact energy and transfer the rest of it to the head in as gradual a manner as possible. To this basic requisite, there are other considerations, of secondary importance from the safety point of view but just as strongly felt, such as comfort, adaptability to varying anatomical features, economy of manufacture, etc.

Known helmets employ a range of padding types. A first type comprises paddings formed from deformable solid materials, mostly polyurethanes. A second type comprises elements composed of deformable blisters containing either air, gases, or liquids, and being variously interconnected together.

With paddings of the first type, the impact energy is absorbed by elastic deformation of the material. Helmets equipped with paddings of this type become useless after being subjected to a shock and only suit, therefore, applications where a shock represents an incidental, quite extraordinary, event, as with motor sports.

Paddings of the second type usually have a first tier of air-filled elastic blisters interconnected into sets, each set being inflatable and deflatable independently of the others, and a second tier of damping blisters filled with a liquid (usually ethylene glycol), being each separate from the others and provided with a respective elastic pouch whereinto, on compression, the liquid flows at a high load loss (and, hence, absorption of energy) and whence it flows out owing to the elastic action of the pouch. These paddings undergo no permanent damage during an impact and the helmet can be re-used. Therefore, they are suitable for applications involving frequent shocks constituting quite an ordinary event, as with American football.

Furthermore, with such paddings, one crash helmet can fit different head sizes. In fact, by inflating the air blisters more or less by means of a specially provided pump supplied separately, the pressure exerted on each region of the head can be varied, thereby the helmet may also be adapted to suit the user's own preferences.

Actually, however, the degree of protection afforded by a helmet incorporating paddings of these type changes according to the dimensions and anatomical configuration of the head.

Where the blisters oppose no appreciable resistance to deformation (e.g. with bellows-type blisters), a larger size head would be less well protected because surrounded by relatively "deflated" blisters which are so highly deformable as to result easily in a "bottoming out" situation, that is contact of the head with the helmet outer shell.

By contrast, in the most frequent instance of blisters having more resistant walls to deformation, difficulties would be encountered with smaller size heads; in this case, in fact, blisters would have to be inflated at a high pressure in order to clamp on the head at the usual initial pressure. The padding would thus be extremely stiff and little effective to absorb a shock.

Like considerations apply also to the varying anatomical configurations of the heads; given the widely varying shapes and proportions of a head, it would be often found that different areas are protected by different thicknesses of the padding, which results in the same problems of protection differences outlined above.

Conventionally, such differences can only be obviated by providing a range of helmet sizes and shapes to fit the head anatomical features.

In all cases, moreover, the helmet would require a tuning step, so to speak, whereby all the blister sets are to be inflated to the most appropriate pressures, by means of the separate pump, which is evidently inconvenient and time-consuming.

It is an object of this invention to provide a padding element which allows crash helmets to be manufactured which can fit different size and shape heads, and ensure the utmost safety at all times.

DISCLOSURE OF INVENTION

According to the invention, that object is achieved by a padding element of the above-specified type, characterized in that the deformable blister contains a fluid which, with the padding element in its in-use condition, is in a state of saturated vapor.

BRIEF DESCRIPTION OF DRAWINGS

Further features and advantages of a padding element according to the invention will be apparent from the following description of a preferred embodiment thereof, given herein with reference to the accompanying drawings. In the drawings.

MODES FOR CARRYING OUT THE INVENTION

Figure 1:
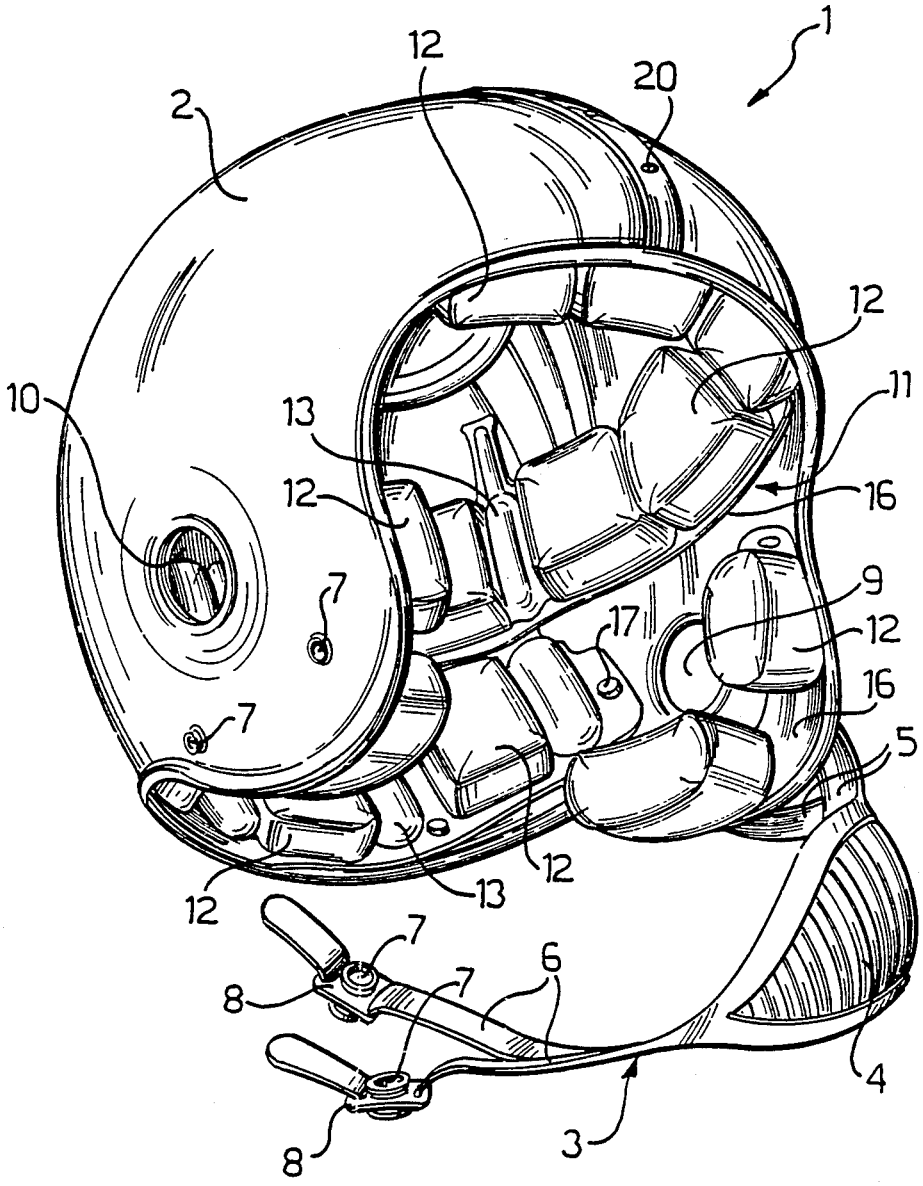
FIG. 1 is a prospective view of a crash helmet incorporating padding elements according to the invention.

A crash helmet, exemplified by the football helmet 1, comprises a rigid outer shell 2, and an adjustable chin strap 3, the chin strap 3 has a cup-shaped middle portion 4 to fit under the chin of a user, and split end portions to form a pair of substraps at each of them, respectively a pair of sub-straps 5 and a pair of sub-straps 6. The sub-straps 5 are attached to the shell 2 permanently (e.g. by means of rivets, not shown), whereas the sub-straps 6 are adapted to be fastened adjustably to the shell 2 through buckles 8 positionable movably along the sub-straps 6 by engagement of the buckle snaps 7 with the fixed snaps 7 on shell 2.

The shell 2 is also formed with two openings 9 and 10 intended to coincide in use with the user's ears.

The helmet 1 is provided internally with a protective buffer padding, generally indicated at 11.

The padding 11 comprises a plurality of padding elements (indicated at 12 and 13 and explained hereinbelow) which have various configurations and are arranged on the interior of the shell 2.

The padding elements 12, 13 comprises cells of a deformable material having a substantially flattened shape and bearing on the interior of the shell 2, the cells being often referred to as blisters and so termed in the description that follows and the appended claims.

The blisters 12 and 13 are grouped together into bands 16, fastened to the shell 2 by means of snap buttons or the like; in practice, each band 16 could be formed by sealing together two suitably shaped material sheets so as to have the aforesaid blisters 12 and 13 defined on completion of the sealing step.

Figure 2:
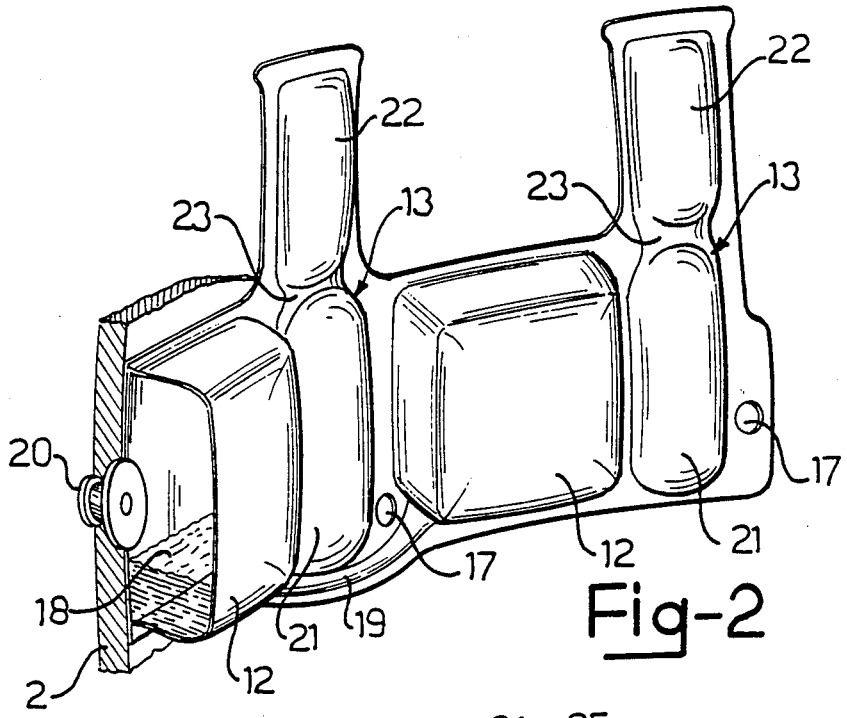
FIG. 2 is a partial sectional perspective view of some padding elements of the helmet of FIG. 1, in the in-use condition thereof.

The blisters 12 contain a fluid 18 having such chemical and physical charateristics as to be in a saturated vapor state with the helmet in its in-use condition; in other words, while the helmet 1 is being worn, the fluid 18 within the blisters 12 is partly in a liquid state and partly in a vapor state (see FIG. 2); its temperature is dependent on the condition of use, i.e. on the closeness of its contact with the human body, and equal approximately to 36° C., whilst its pressure depends on the fluid. The fluid is selected to provide a pressure level appropriate to clench on the user's head (i.e. barely higher than one atmosphere).

Appropriate for the purpose has shown to be a mixture of Freon MF (also known as algophrene 11 having the raw formula $CCl_3F$) and Freon TF (also known as algophrene 113 or delyphrene HP having the raw formula $C_2Cl_3F_3$). Individually taken, Freon MF and Freon TF have, at atmospheric pressure, their boiling points at approximately 23° C. and 47° C., respectively. It has been found that mixtures of these two fluids containing an amount in the range of 20 to 50% (by volume of liquid) of Freon MF fulfill the requirements; of these, the mixtures containing more Freon MF (the more volatile component) are those which yield the highest pressure for a given temperature. For the average user, it has been found that the best mixture is one containing 30% Freon MF and 70% Freon TF (both percentages being again referred to volumes of liquid).

The blisters 12 in one band 16 may be separate from one another or, as in the helmet 1 shown, interconnected together by conduits 19 formed in the band 16, or alternatively, they may be partly separated and partly interconnected.

The individual blisters 12 or sets of interconnected blisters by the conduits 19 may be sealed at the factory, after introducing the fluid 18 thereinto, or be provided (like in the example shown) with a filler valve 20 accessible from outside the shell 2, whereby amounts of either components may be added to change the operating pressure according to the user's own preference.

The blisters 13 are instead of a damping kind and have a smaller thickness than the blisters 12. They comprise a main chamber 21 and a secondary pouch 22 communicating with each other through a necked in portion 23, and contain a liquid, typically ethylene glycol. Advantageously, such blisters 13 would alternate with blisters 12 within one band 16.

The operation and manner of using the helmet 1 will be now described.

After wearing the helmet 1, within a short time period (on the order of a few minutes), the fluid 18 in all the blisters 12 will reach its operating temperature of about 36° C. and begin boiling; thus, the condition of equilibrium is established with the simultaneous presence of liquid and vapor and at a constant pressure level which is determined solely by the temperature, regardless of the volumes yielded, so long as the amount of the fluid 18 is adequate for the purpose. It is in fact well known that in the equilibrium condition, the pressure of a saturated vapor only depends on the temperature.

Accordingly, one and the same pressure is established automatically in all of the blisters 12, irrespective of the extent of their squeezing due to different anatomical configurations of the user's head. Thus, the helmet will fit any head in a perfect automatic manner.

If the helmet is subjected to a shock while in use, the resulting pressure increase within the blisters 12 would be limited by a change of phase; part of the impact energy, moreover, would be dissipated by friction through the conduits 19. After a shock, the original condition is restored and the system is once again ready to absorb further shocks with unchanged efficiency. The increased capability for shock absorption of the saturated vapor blisters 12 over traditional air- or gas-filled blisters is apparent.

The crash helmet 1 shown also includes padding elements other than the saturated vapor blisters 12, namely the damping blisters 13. The damping blisters 13 are to provide a sort of a compliant travel limiter for the blisters 12 in the event of particularly violent shocks. The operating features of the damping blisters 13 are well known and touched upon in the preamble to this description, thereby they will be no further explained.

As is apparent from the foregoing description, a padding element according to the invention is not only suitable for use with crash helmets but also with any other paddings intended for use in contact with the body, with or without a rigid outer structure; as an example, a padding element according to the invention may be used to advantage with shoulder guards, shin guards, sport caps (for skiing, horseriding, etc.), and with padded garments (trousers, jackets, ski suits, etc.), footwear and so forth.

In particular, a padding element according to the invention is suitable for skiboots, and winterboots in general; in such cases, the possiblity of perfect adaptation to different foot shapes and proportion and the comfort would be more important than the shock absorbing performances. A good thermal insulation too would be obtained by using this padding element.

The non-hazardous nature of the fluid used in the inventive padding element should also be noted. In fact, Freon MF and Freon TF would not react with the plastics employed in the manufacture of crash helmets and are nonflammable. Furthermore, their toxicity is virtually nil; even incidental contact with the eyes would only result in temporary slight irritation.

Such advantages, while not involving the user directly, are instead of great importance to the manufacturing process, wherein personnel is to handle this substances.

Figure 3:
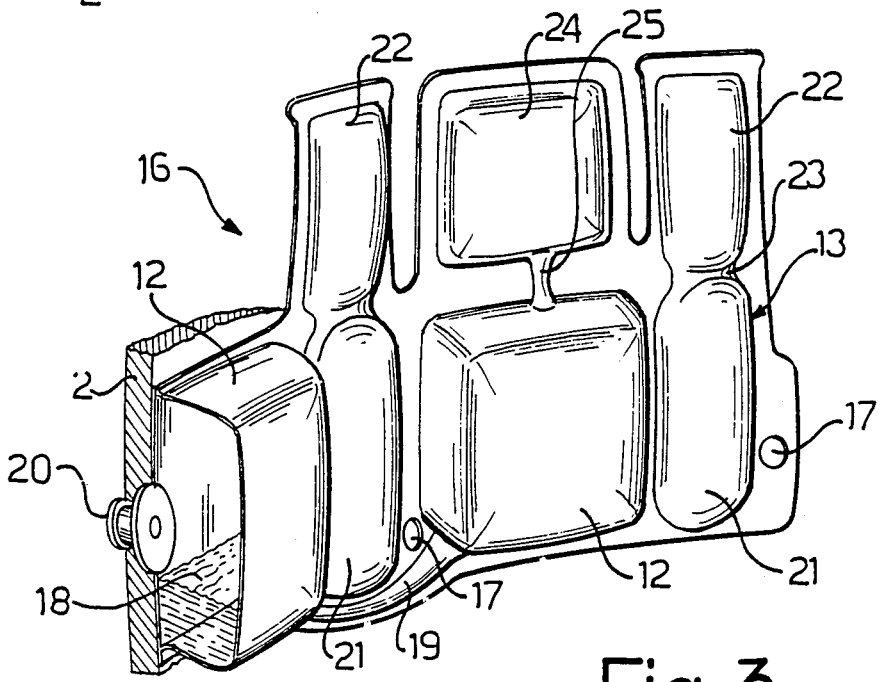
FIG. 3 is a partial sectional prespective view of some padding elements in a modified embodiment of the invention.

FIG. 3 shows a different embodiment of the padding element according to the invention, wherein each set of blisters 12 is provided with an expansion chamber 24 which is in communication with the blisters 12 through a passage 25. The passage 25 is controlled by a pressure relief valve member which only allows communication on reaching a preset pressure level; advantageously, and as shown in FIG. 3, that valve member would comprise the deformable walls of the passage 25 itself, as suitably dimensioned such that below a certain pressure level the passage is blocked, and above it the passage is open to leave a very small passage cross-section.

An appropriate choice of the pressure level at which the passages 25 open will enable fluid overheating (as due to exposure to sunlight, for example) to cause no overpressure on the user's head. On the other hand, the small cross-sectional area makes the presence of the passages 25 practically uninfluential in case of a shock.

With the variation just described, the added advantage is afforded that the helmet may also be used at very high ambient temperature, in excess of the bodily temperature, without this requiring that the fluid composition be changed.

I claim:

1. A protective buffer padding element adapted to be worn in external contact with a human body comprising:

a deformable blister, said blister containing a fluid which is capable of being in a saturated vapor state with the padding element after the padding element is worn for a sufficient period of time to raise the fluid temperature to a temperature approaching normal human body temperature; and means for retaining the padding element in external contact with a human body.

2. A protective buffer padding element, particularly for use with a crash helmet, adapted to be worn in external contact with a human body comprising:

a plurality of padding elements, at least some of said padding elements being deformable blisters which contain a fluid which is capable of being in a saturated vapor state when worn for a sufficient time to raise the fluid temperature to a temperature approaching normal human body temperature; and means for retaining said padding elements in external contact with a human body.

3. A protective buffer padding element according to claim 2, wherein said blisters containing said fluid are interconnected together in sets.

4. A protective buffer padding element according to claim 3, wherein said sets of interconnected blisters are each provided with a respective filler valve.

5. A protective buffer padding element according to claim 3, wherein said sets of interconnected blisters are each provided with a respective expansion chamber in communication with said blisters through a pressure relief valve member.

6. A protective buffer padding element according to claim 4, wherein said sets of interconnected blisters are each provided with a respective expansion chamber in communication with said blisters through a pressure relief valve member.

7. A crash helmet incorporating a protective buffer padding comprising a plurality of padding elements adapted to be disposed in contact with the head of a human person wearing the helmet, each of said padding elements including:

a plurality of first deformable blisters secured in said helmet and interconnected together in sets and containing a fluid which is capable of being in a saturated vapor state when the helmet has been worn for a sufficient time to raise the fluid temperature to a temperature approaching normal human body temperature; and a plurality of second damping deformable blisters secured in said helmet and containing a fluid each composed of a main chamber and a second pouch in mutual communication through a necked-in portion.

8. A crash helmet according to claim 7, wherein each of said sets of first blisters is provided with a respective filler valve.

9. A crash helmet according to claim 7, wherein each of said sets of interconnected blisters is provided with a respective expansion chamber in communication with said blisters through a pressure relief valve member.

10. A crash helmet according to claim 8, wherein each of said sets of interconnected blisters is provided with a respective expansion chamber in communication with said blisters through a pressure relief valve member.

11. A crash helmet according to claim 7, wherein said fluid is a mixture of Freon MF and Freon TF, the proportion of Freon MF being in the range of 20% to 50% by volume of liquid.

12. A crash helmet according to claim 11, wherein said mixture comprises 30% Freon MF and 70% Freon TF by volume of liquid.

13. A protective buffer padding element as set forth in claim 1 or 2 wherein said fluid is a mixture of Freon MF and Freon TF, the proportion of Freon MF being in the range of 20% to 50% by volume of liquid.

14. A protective buffer padding element as set forth in claim 13, wherein said mixture comprises 30% Freon MF and 70% Freon TF by volume of liquid.

* * * * *

UNITED STATES PATENT AND TRADEMARK OFFICE

CERTIFICATE OF CORRECTION

PATENT NO. : 4,853,980

DATED : August 8, 1989

INVENTOR(S) : Claudio Zarotti

It is certified that error appears in the above-identified patent and that said Letters Patent is hereby corrected as shown below:

On the cover page:

Item [22] should read

[22] PCT filed: December 16, 1985

Between items [22] and [30] please insert

[86] PCT No.: PCT/EP85/00712

§ 371 Date: Aug. 19, 1986

§ 102(e) Date: Aug. 19, 1986

[87] PCT Pub. No.: WO 86/03655

PCT Pub. Date: July 3, 1986

[30] Foreign Application Priority Data should read as follows:

Dec. 21, 1984 [IT] Italy..... 24165 A/84

Signed and Sealed this

First Day of January, 1991

*Attest:*

HARRY F. MANBECK, JR.

*Attesting Officer*

*Commissioner of Patents and Trademarks*